US008513509B2

(12) United States Patent
Ramirez

(10) Patent No.: US 8,513,509 B2
(45) Date of Patent: Aug. 20, 2013

(54) UCR (USER CONFIGURABLE RISER)

(76) Inventor: Anthony Ramirez, Poway, CA (US)

( * ) Notice: Subject to any disclaimer, the term of this patent is extended or adjusted under 35 U.S.C. 154(b) by 0 days.

(21) Appl. No.: 13/200,283

(22) Filed: Sep. 21, 2011

(65) Prior Publication Data

US 2012/0073421 A1 Mar. 29, 2012

Related U.S. Application Data

(60) Provisional application No. 61/403,985, filed on Sep. 23, 2010.

(51) Int. Cl.
*G10D 13/02* (2006.01)

(52) U.S. Cl.
USPC ..... 84/421

(58) Field of Classification Search
USPC ..... 84/421
See application file for complete search history.

(56) References Cited

U.S. PATENT DOCUMENTS 2,508,627 A * 5/1950 Spiegel et al. ..... 108/19
D180,759 S * 8/1957 Allen ..... D17/22
2,836,475 A * 5/1958 Sapp ..... 108/64
2,978,754 A * 4/1961 Wilson ..... 108/170
3,096,677 A * 7/1963 Ryan ..... 84/421
3,181,203 A * 5/1965 Wenger ..... 52/6
3,659,032 A * 4/1972 May ..... 84/600
3,693,754 A * 9/1972 Butler ..... 182/86
3,891,052 A * 6/1975 Lee et al. ..... 182/88
4,150,630 A * 4/1979 Pokorny et al. ..... 108/64
4,240,646 A * 12/1980 Scott ..... 280/30
4,301,627 A * 11/1981 Wilson ..... 52/6
4,479,414 A * 10/1984 Willis ..... 84/421
4,579,229 A * 4/1986 Porcaro et al. ..... 211/85.6
4,580,776 A * 4/1986 Burkinshaw ..... 52/7
4,691,611 A * 9/1987 May ..... 84/421
4,779,542 A * 10/1988 Staten et al. ..... 108/170
5,161,761 A * 11/1992 May ..... 248/122.1
5,333,557 A * 8/1994 Eickhoff ..... 108/65
5,337,646 A * 8/1994 Austin ..... 84/421
5,392,718 A * 2/1995 Stevens ..... 108/167
5,408,790 A * 4/1995 Hoesten et al. ..... 52/263
5,438,937 A * 8/1995 Ball et al. ..... 108/64
5,520,292 A * 5/1996 Lombardi ..... 211/85.6
5,531,148 A * 7/1996 Wilson ..... 84/412
5,613,450 A * 3/1997 Wagner et al. ..... 108/175
5,653,459 A * 8/1997 Murphy ..... 280/166
D400,565 S * 11/1998 Ahl ..... D17/22
5,994,634 A * 11/1999 Cady ..... 84/421
6,006,680 A * 12/1999 Quam et al. ..... 108/179
6,471,078 B2 * 10/2002 Pyle ..... 211/85.6
6,610,916 B1 * 8/2003 Torrez ..... 84/421

(Continued)

*Primary Examiner* — David Warren
*Assistant Examiner* — Robert W Horn

(57) ABSTRACT

A drum riser incorporating third party clamps and bars making one sturdy rack and riser combination. The third party clamps are attached to the riser by way of the clamp receivers. These receivers are placed in several locations to accommodate multiple configurations. The receivers are mounted by bolts to the riser making them removable so they can be moved to different locates on the riser. The risers small platform is achieved by mounting the rack out at an angle and attaching all components from the rack; allowing for the most space saving configuration possible. The riser can be manipulated to accommodate acoustic drums, electronic drums, and hand percussion. The height of the riser can be adjusted by interchanging the riser legs, which are available in varying heights. The riser is constructed of a rigid metal and welded together making a solid and durable unit.

4 Claims, 13 Drawing Sheets

(56) References Cited

U.S. PATENT DOCUMENTS

| | | | | |
|---|---|---|---|---|
| 7,928,304 | B2 * | 4/2011 | Eason et al. | 84/421 |
| 8,088,984 | B2 * | 1/2012 | Meyer et al. | 84/421 |
| 2005/0011135 | A1 * | 1/2005 | Hallberg | 52/7 |
| 2005/0268772 | A1 * | 12/2005 | Schaff | 84/421 |
| 2008/0163739 | A1 * | 7/2008 | Mori | 84/421 |
| 2009/0151539 | A1 * | 6/2009 | Baskerville | 84/421 |
| 2012/0073421 | A1 * | 3/2012 | Ramirez | 84/421 |
| 2013/0074676 | A1 * | 3/2013 | Waitzman et al. | 84/421 |

* cited by examiner

UCR (USER CONFIGURABLE RISER)

PRIOR APPLICATION

This is a continuation of provisional application Ser. No. 61/403,985 filed Sep. 23, 2010.

FIELD OF THE INVENTION

This invention relates to elevated platforms relative to musical instruments; drum mounting rack systems specifically.

BACKGROUND OF THE INVENTION

Drum risers have been used for several years to elevate the drummer and their equipment making them more visible to the audience; and enabling the drummer to make eye contact with other members of the band.

Drum racks have been in use for several years. They are used to support drums, cymbals, and other percussion instruments. These racks consist of straight and curved bars attached with various clamps and can be setup in several ways to adapt to several acoustical drums, electronic drums, keyboards, percussion instruments, and other musical instrument configurations.

Clamps for these racks are readily available in several different configurations (90 degree right angle, adjustable right angle, adjustable angles, and drum accessory mounting clamps and others).

SUMMARY OF THE INVENTION

The objective of this invention is to provide a solid platform to mount, with clamps and bars readily available, a drum rack that also functions as a riser. This platform or riser would hold the rack and drums securely. The components are directly mounted to the riser; providing a secure and solid foundation.

The riser would also bring the drummer and their instruments up off the floor, affording excellent visibility to the audience.

In the case of acoustic bass drums, the bass drums are suspended from the riser providing the ability to resonate in 360 degrees, giving the bass drums a fuller sound and volume.

BRIEF DESCRIPTION OF THE PHOTOS/DRAWINGS

DESCRIPTION OF THE PREFERRED FABRICATION OF THE INVENTION

Figure 7:
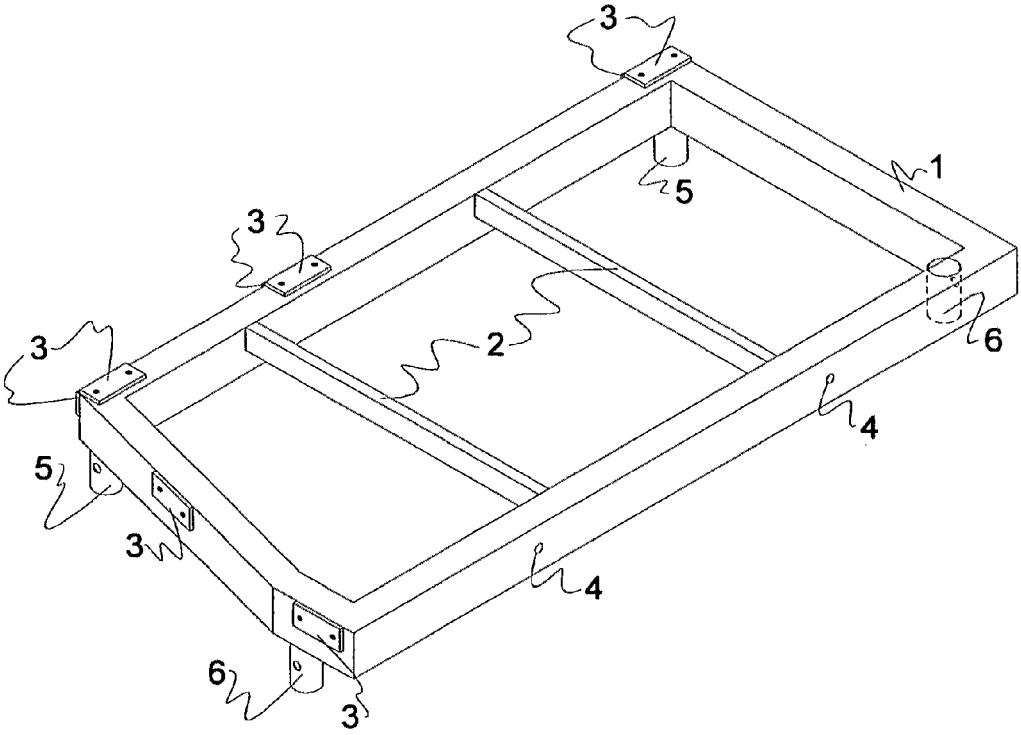
FIG. 7 illustrates the riser's right side of the UCR shown with no flooring.
Figure 8:
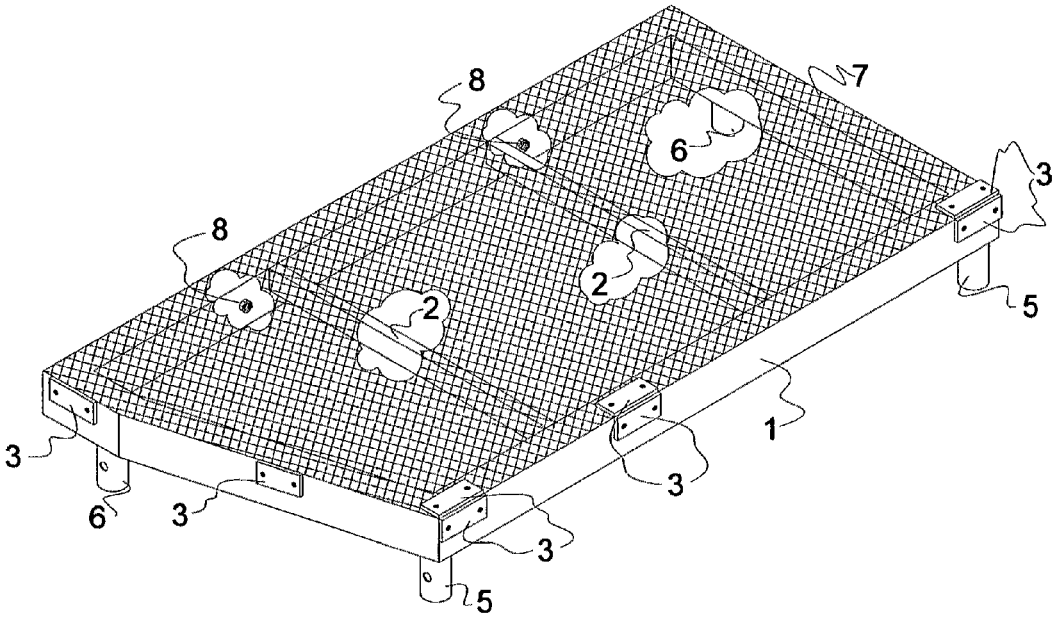
FIG. 8 illustrates the riser's left side of the UCR shown with expanded metal flooring.

Referring to the drawing, shown in FIG. 7, the main structure 1 of the UCR is made of 2×3 inch rectangular tubing. The frame is 26 inches wide by 50 inches long. FIG. 7 is shown with no flooring in place. See FIG. 8 for flooring. The frame of FIG. 8 is a mirror image of FIG. 7. Flooring support struts 2 are welded between the frame rails of the main structure 1 at equal distances. The clamp support mounts 3 are welded to at least eight locations on each riser half as shown in FIG. 7 and FIG. 8. The clamp support mounts 3 are explained in more detail on FIG. 12. The riser fastening holes 4 are drilled fourteen inches from the front of the main structure 1 and again from the back of the main structure 1, on both halves of the riser. The fastening holes 4 are explained in more detail in FIG. 11. The outside riser leg receivers 5 are welded to the bottom of the main structure 1 at two locations on the outside of each riser half as shown in the FIG. 7 and FIG. 8. The inside riser leg receivers 6 are welded to the bottom of the main structure 1 four and a half inches on center of each riser half as shown in the FIG. 7 and FIG. 8. This is to accommodate optional caster receivers 14 (see FIG. 10).

FIG. 8 is a mirror image of FIG. 7 shown with expanded metal flooring 7. Expanded metal floor 7 is cut to size and welded to the top of the main structure 1 as shown in FIG. 8. Carpet can be used as alternative flooring. The stationary securing nuts 8 are welded in place as shown in FIG. 8 and are explained in more detail in FIG. 11.

Figure 9:
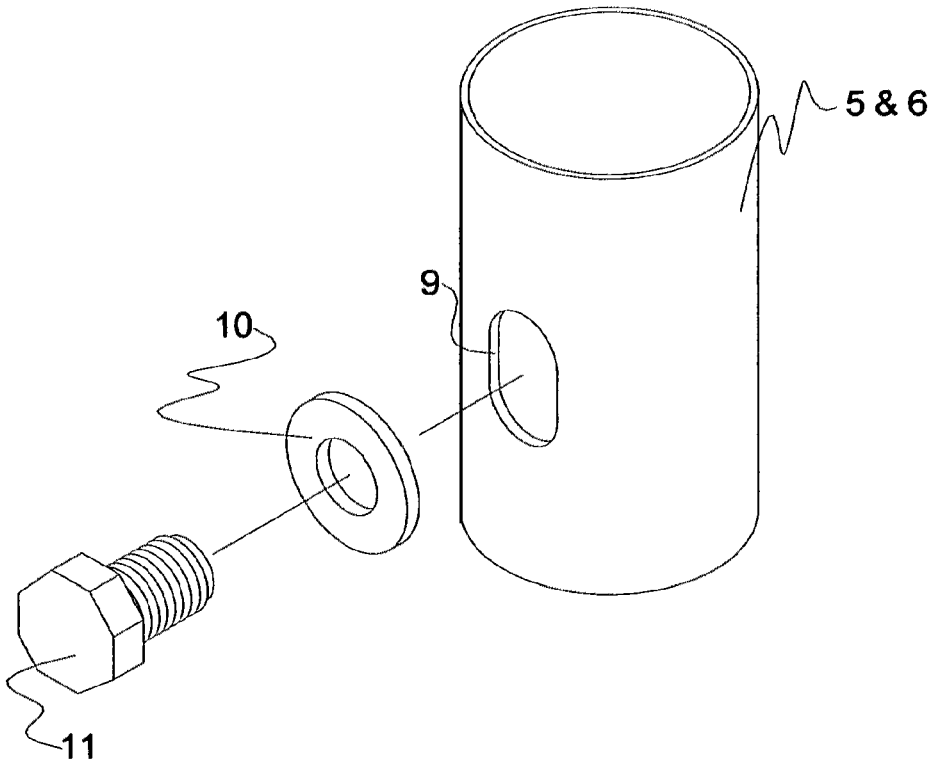
FIG. 9 illustrates the riser leg receiver.

FIG. 9, riser leg receivers 5 & 6 are welded to the bottom of the main structure 1, see FIG. 7 and FIG. 8 for location details. Riser leg receivers 5 & 6 are made of 1¾ inch OD round tubing, 0.095 in thickness. Riser leg receivers 5 & 6 are three inches long with a 9⁄16 inch hole 9 drilled at one and a half inches from the top of each riser leg receiver 5 & 6. Each hole 9 is elongated ¼ inch toward the bottom of each riser leg receiver 5 & 6. Insert bolt 11 into washer 10. The washers 10 are ½ inch standard flat washer. The bolts 11 are ½ inch-13, one inch long. Bolts 11 and washers 10 hold the riser legs 12 securely to the riser leg receivers 5 & 6.

Figure 10:
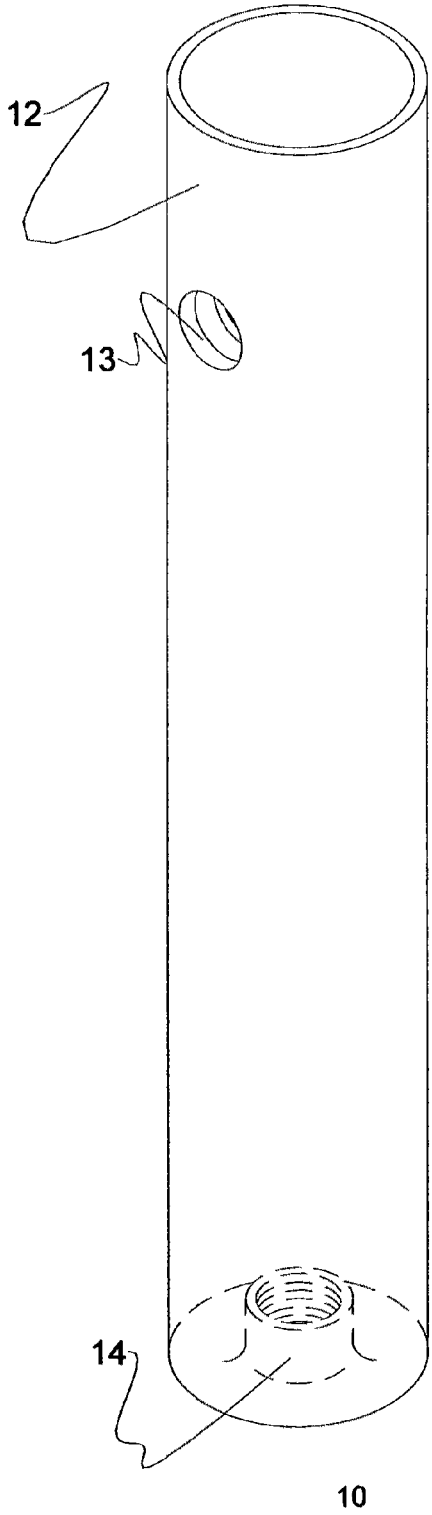
FIG. 10 illustrates the riser leg.

FIG. 10, riser legs 12 are made of 1½ inch OD round tubing and can vary in length depending on the desired height of the riser. The riser legs 12 are mounted to the riser leg receivers 5 & 6 (see FIG. 9) by drilling a hole 13 one and a half inches from the top of each riser leg 12 and inserting a ½ inch-13 nut into each drilled hole 13 and welding each nut to each riser leg 12 and grinding each nut smooth. The riser legs 12 are secured by using the bolts 11 and washers 10 as shown in FIG. 9. The caster receivers 14 are welded to bottom of each riser leg 12. The caster receivers 14 are welded to each riser leg 12 and will accommodate ½ inch-13 stemmed casters.

Figure 1:
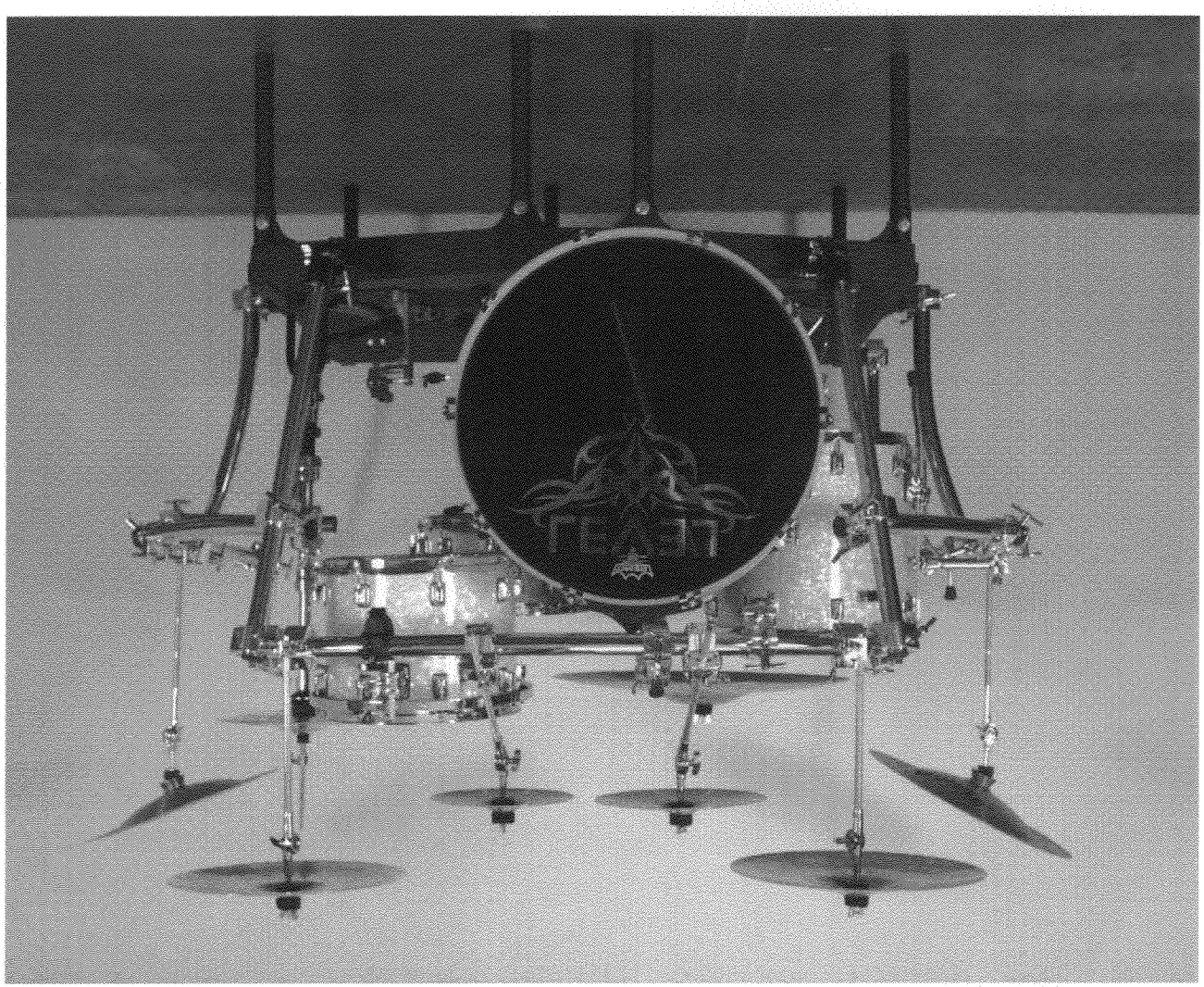
FIG. 1 is a photo of the prototype UCR with a single bass setup from the front view. Shown with drums, clamps, rack bars, cymbals and accessories.
Figure 2:
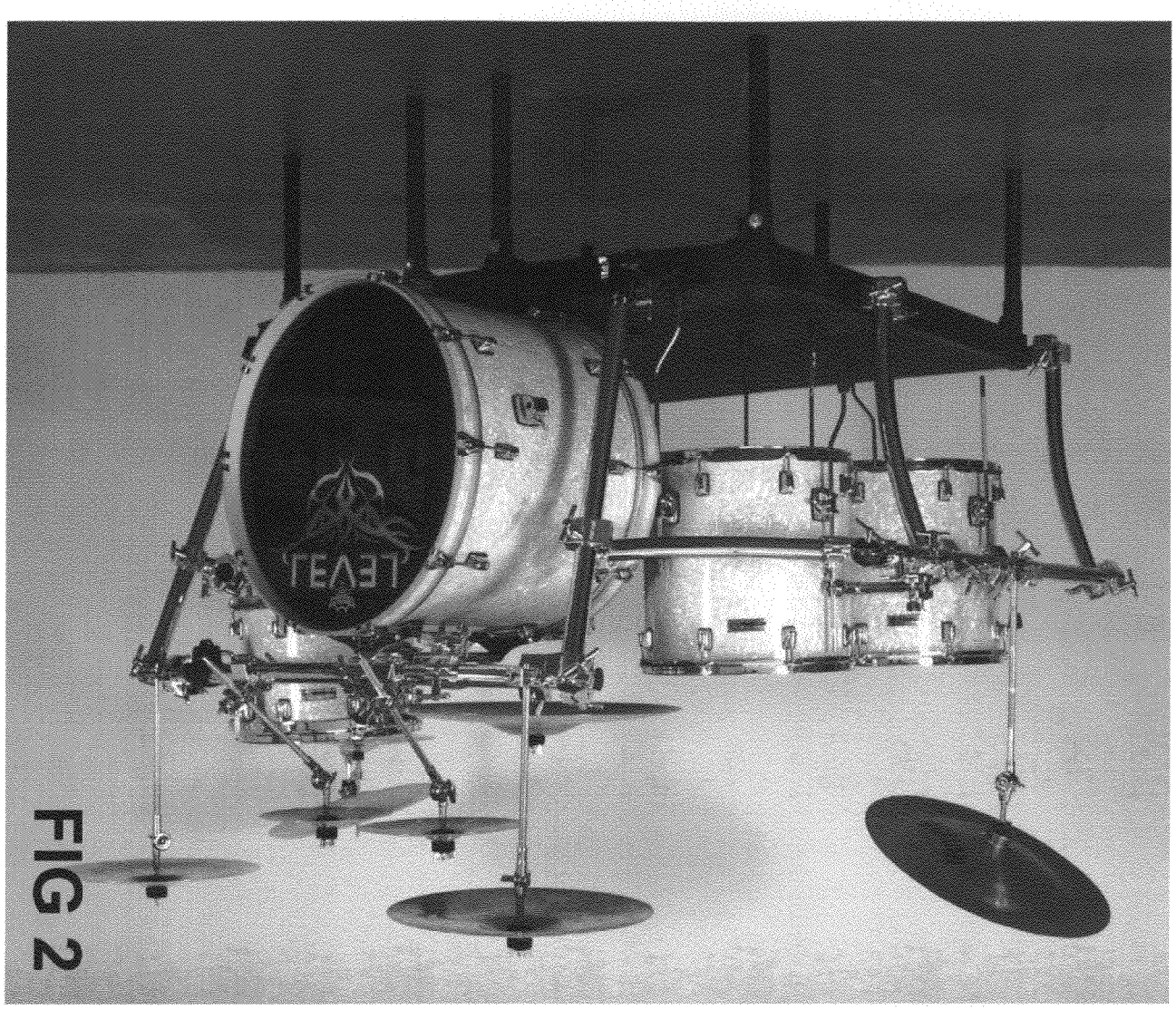
FIG. 2 is a photo of the prototype UCR with a single bass setup from the right side view. Shown with drums, clamps, rack bars, cymbals and accessories.
Figure 3:
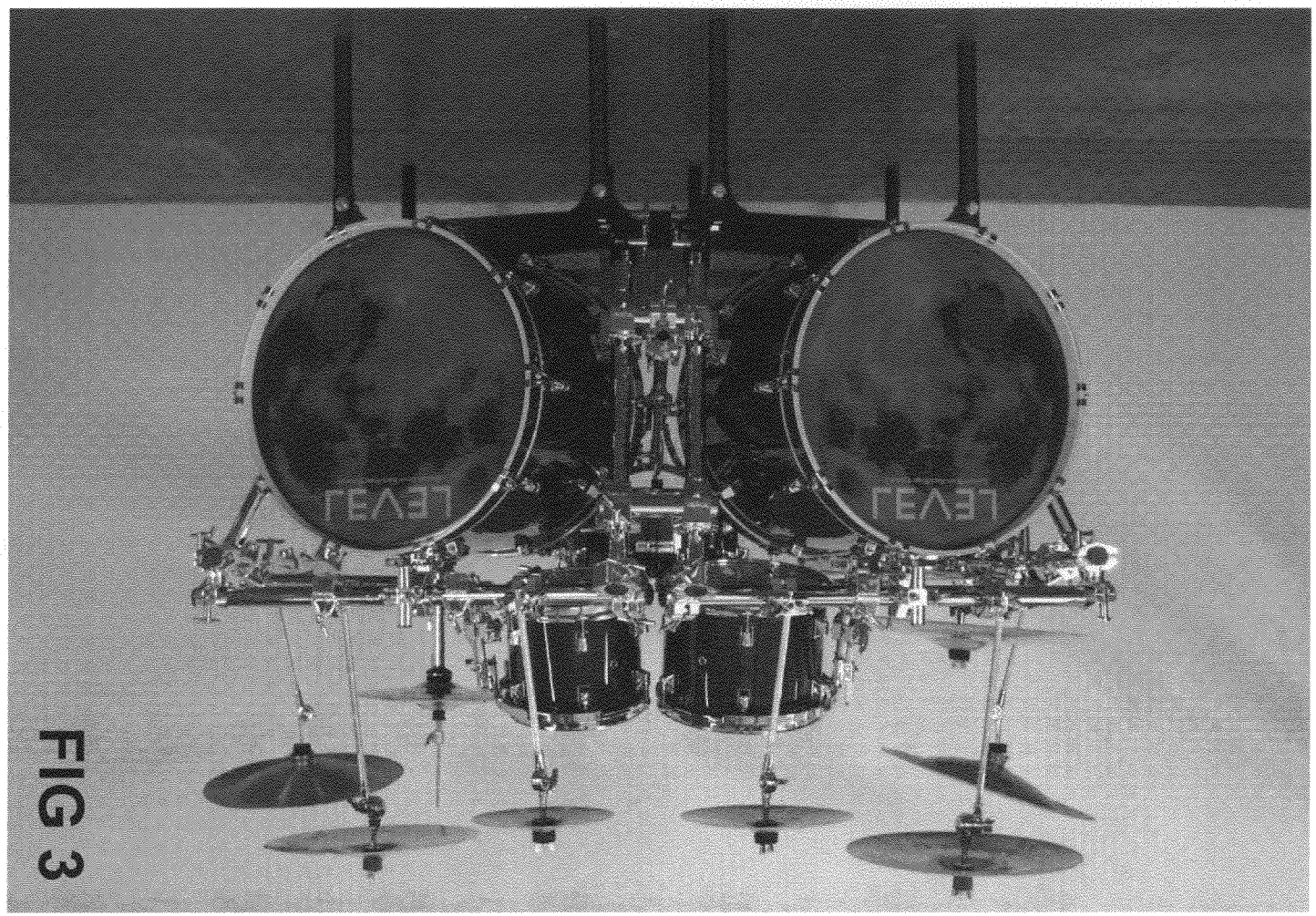
FIG. 3 is a photo of the prototype UCR with a double bass setup from the front view. Shown with drums, clamps, rack bars, cymbals and accessories.
Figure 4:
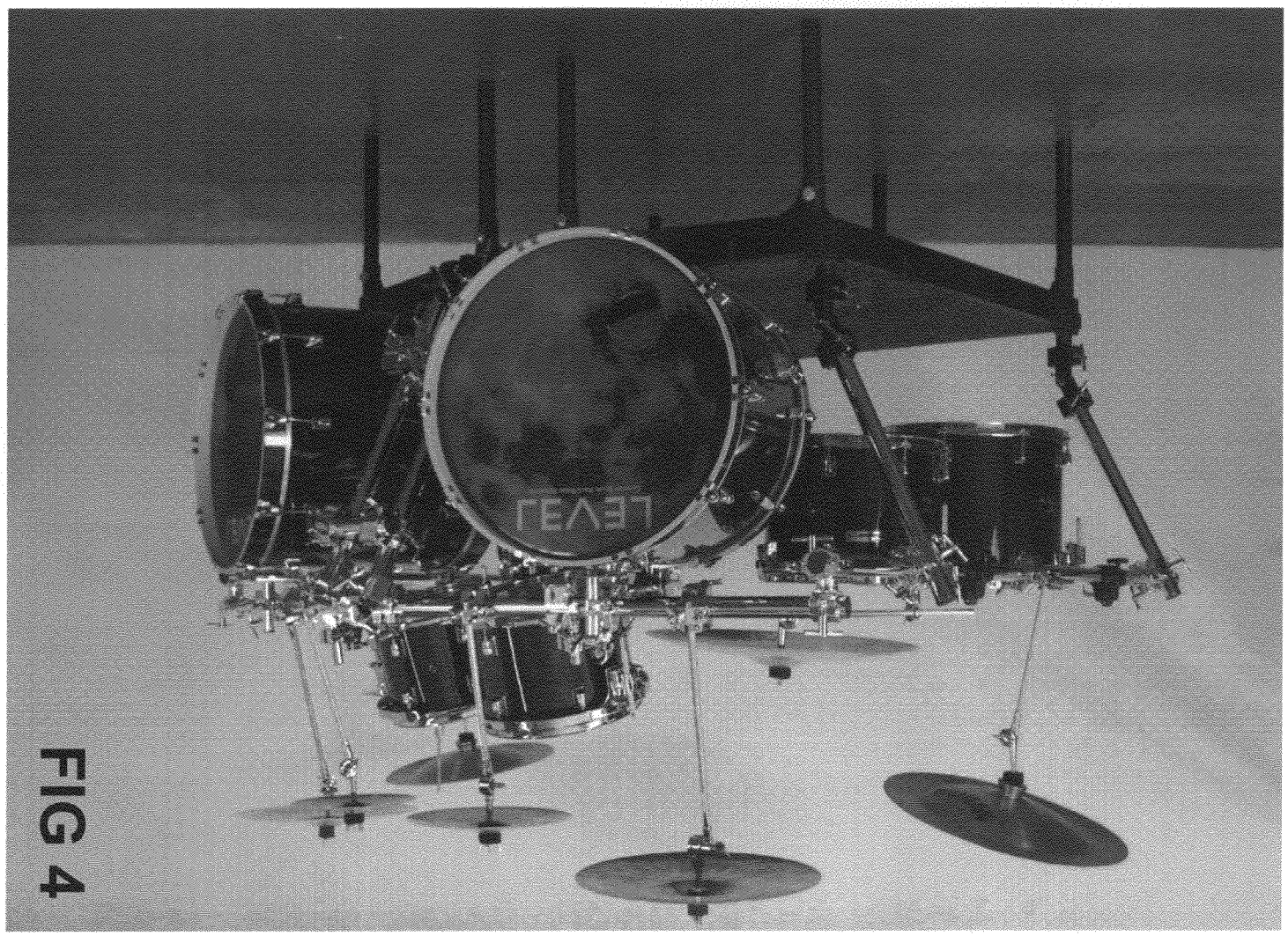
FIG. 4 is a photo of the prototype UCR with a double bass setup from the right side view. Shown with drums, clamps, rack bars, cymbals and accessories.
Figure 5:
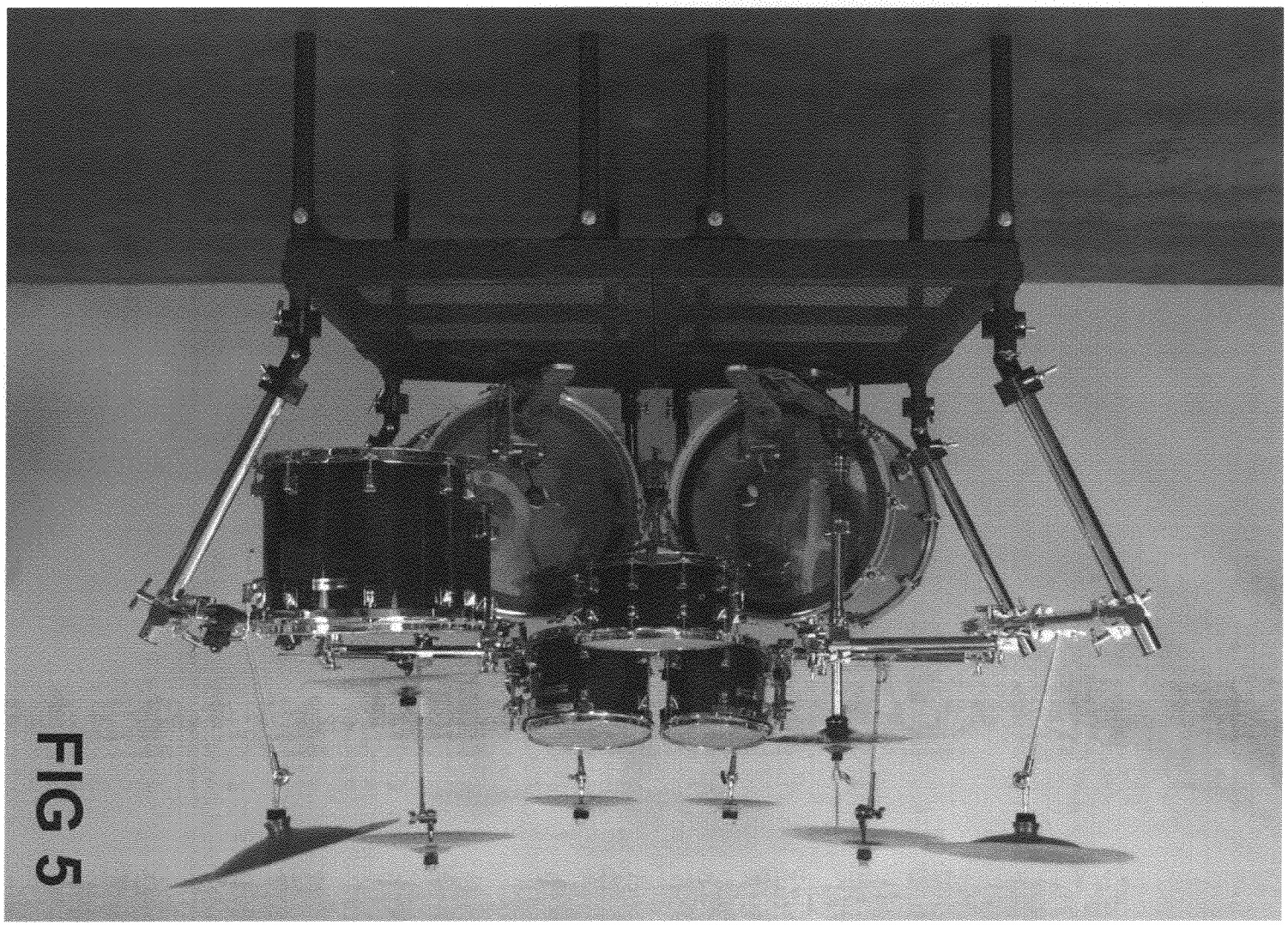
FIG. 5 is a photo of the prototype UCR with a double bass setup from the rear view. Shown with drums, clamps, rack bars, cymbals and accessories.
Figure 6:
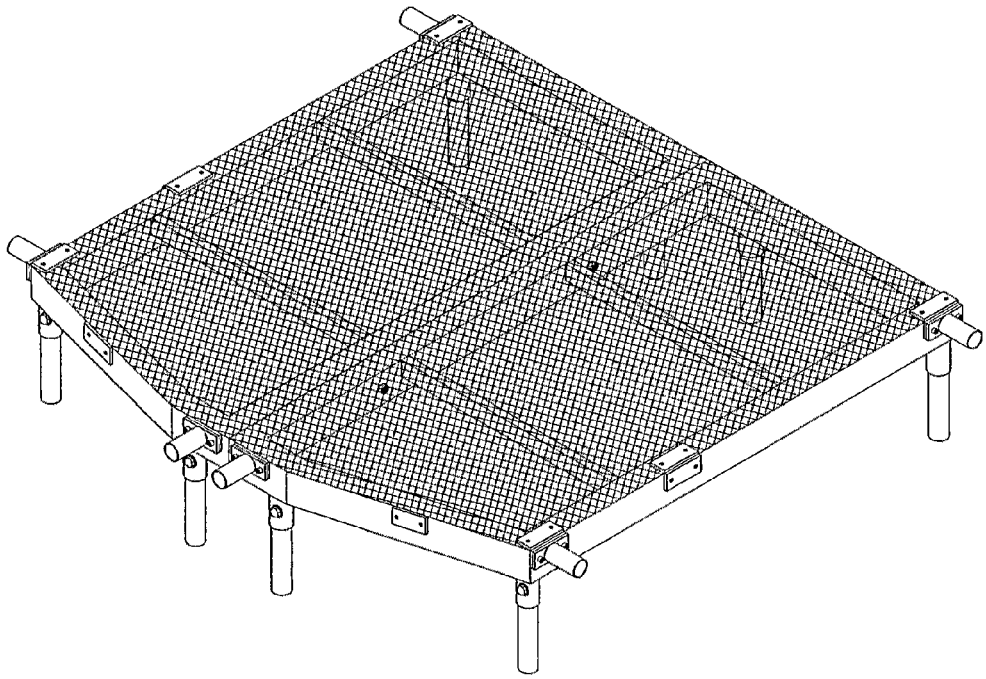
FIG. 6 illustrates the assembled UCR.
Figure 11:
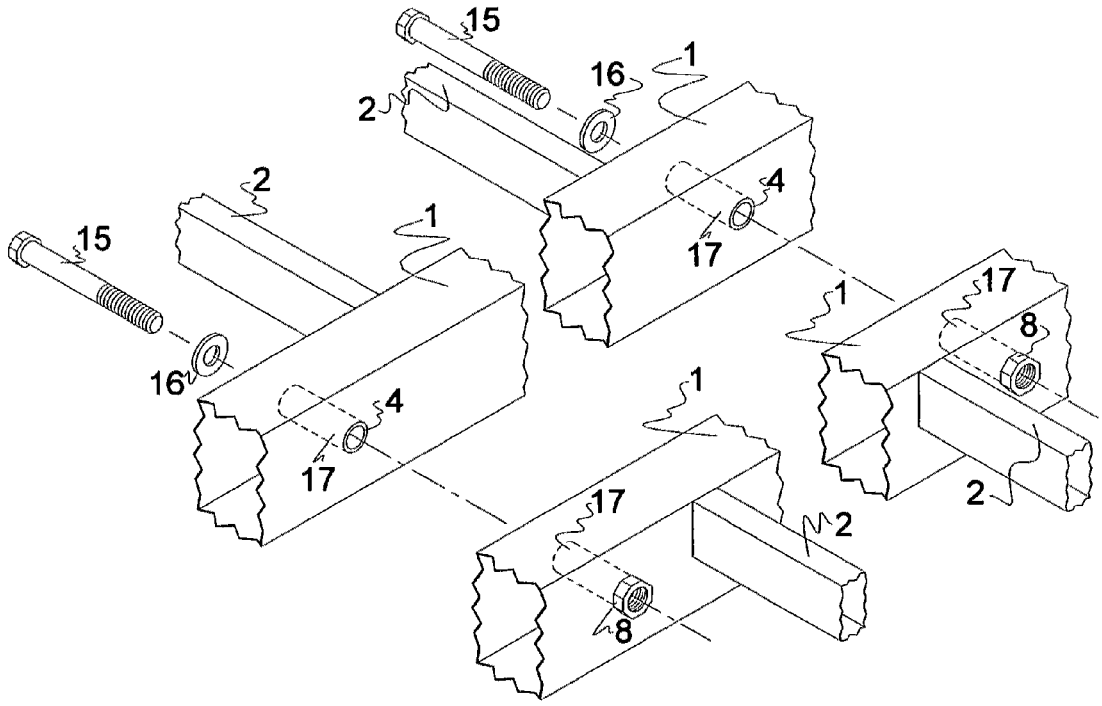
FIG. 11 illustrates the fastening system to join the two riser halves.

FIG. 11, fastening holes 4 are drilled to accommodate a ¾ inch OD tubing welded in place to provide non-collapsing supports 17. This procedure is performed at two locations on both halves (FIG. 7 and FIG. 8) as shown in FIG. 11. Stationary securing nut 8 is ½ inch- 13 and is welded to the outside of each of the non-collapsing supports 17, at each of the fastening holes 4 on the inside of main structure 1, of FIG. 8 only. When the two halves are joined, FIG. 7 and FIG. 8, the five inch long, ½ inch-13 bolts 15 with the ½ inch flat washers 16 are inserted through the non-collapsing support holes 17 through to the stationary securing nuts 8 and tightened to hold the halves (FIG. 7 and FIG. 8) securely as shown in FIG. 6.

Figure 12:
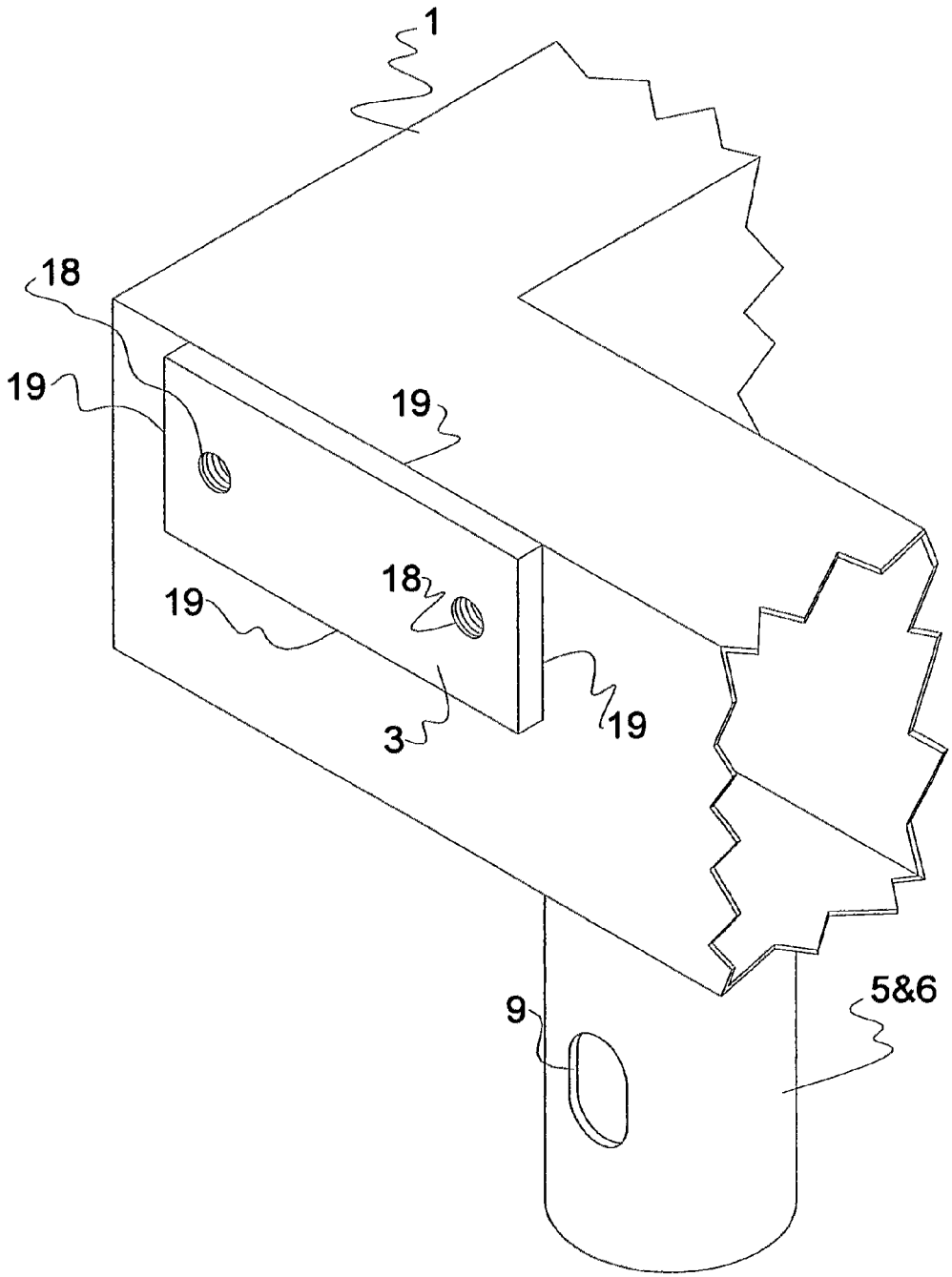
FIG. 12 illustrates the clamp support mount.

FIG. 12, clamp support mounts are engineered from a piece of three and a half inch long, 1½×¼ inch flat bar. Drilled and tapped 5/16-24 holes 18 are centered ½ inch in from both ends of the clamp support mount 3 as shown in FIG. 12. Each side 19 of the clamp support mounts 3 are welded to the main structure 1. These clamp support mounts 3 are located in at least eight locations, per riser half, as shown in FIG. 7 and FIG. 8.

Figure 13:
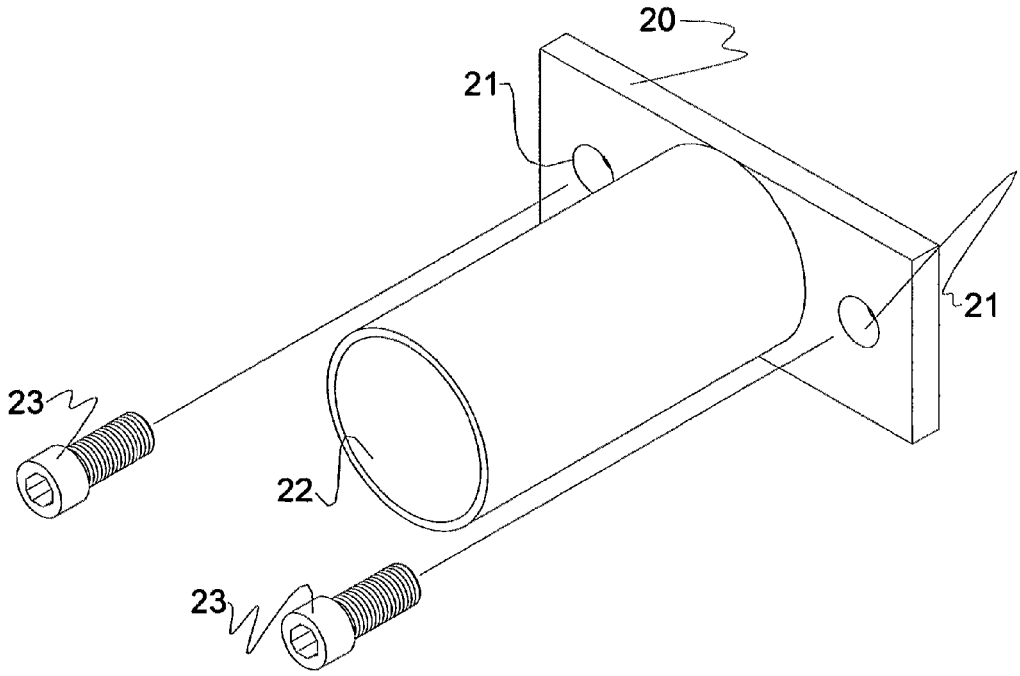
FIG. 13 illustrates the clamp receiver.

FIG. 13, clamp receivers are made up of a clamp support base 20 and a clamp support tube 22. The clamp support base 20 is a piece of three and a half inch long, 1½×¼ inch flat bar. Drilled with ⅜ inch holes 21 centered ½ inch in from both ends of clamp support base 20 as shown in FIG. 13. These holes 21 line up with the 5/16-24 holes 18 (FIG. 12) of the clamp support mounts 3 (FIG. 12). The clamp support tubing 22 is a piece of three inch long, 1½ inch OD round tubing. The clamp support tubing 22 is welded to the center of the clamp support base 20. The clamp receivers (FIG. 13) are secured to the clamp support mounts 3 (FIG. 12) using 5/16-24 bolts 23. The clamp receivers (FIG. 13) are used to provide a foundation for the third party clamps as shown in FIG. 1, FIG. 2, FIG. 3, FIG. 4 and FIG. 5 of the prototype photos. The clamp receivers (FIG. 13) can be moved to the various clamp support mounts 3 (FIG. 7 and FIG. 8) in at least eight different locations on main structure 1 per each riser half as shown in FIG. 7 and FIG. 8. These clamp support mount 3 locations allow for a variety of configurations as shown in FIG. 1, FIG. 2, FIG. 3, FIG. 4 and FIG. 5.

While the preferred embodiments of the invention have been described, modifications can be made and other embodiments may be conceived without departing from the essence of the invention and the scope of the appended claims.

What is claimed is:

1. A portable staging riser that is easily stored and transported, comprising:

two risers, each comprising a frame of four sides, including a front and back end, an inner and outer sides and four corners;

supports at each corner of the frames, suspending the frame;

a floor affixed to the frame, wherein there is provided an area for the suspension of instruments used by a person and for a person to be seated; and wherein the two risers attach together at the respective inner sides and create an extended size floor; and wherein the frame parts at the respective front ends and outer sides have a high strength construction to cooperate with one or more instrument suspension items that mount to the frame and suspend an instrument higher than the said floor and, at least, partially outward from the respective front ends and outer sides of the extended floor, so the extended floor open area that is inward of the instruments provides a larger seating area for a person and an overall size of the riser can be made smaller.

2. The portable staging riser of claim 1, further comprising repositionable clamp receivers on the riser to mount one or more instrument suspension item;

the instrument suspension item, comprising available drum rack bars and clamps that connect readily via the repositionable clamp receivers to said riser frame;

said repositionable clamp receivers can be mounted in both vertical and horizontal positions at varying points on said frame of the riser allowing the use of varying angle clamps;

said varying angle clamps on the instrument suspension items attach directly to the repositionable clamp receivers mounted in vertical and horizontal positions at varying locations on said frame of the riser allowing for clamp rotation on the repositionable clamp receiver to achieve compound angles;

wherein various instruments can be suspended out over the edge of the riser generating a fuller, more resonating sound and allowing for a smaller riser area and a sufficient seating area for a drummer on the riser, wherein an array of percussion instruments is mounted on the riser and the drummer steps in from the back or from either side of the riser into the middle of the array of instruments.

3. The portable staging riser of claim 1, further comprising wherein the supports comprise legs that support said frame at a preselected height above the floor; and the frame further comprising preexisting locations on said frame for receiving the leg by insertion;

a bolt and an elongated slot providing for securing the leg with a bolt through the elongated slot and by adjusting the position in the slot allowing for quick and easy leveling.

4. The portable staging riser of claim 1, further comprising wherein the legs comprise caster mounts receiving casters; and casters for placing in the caster mounts, such that the riser may be rolled about, when casters are placed in the caster mounts.

* * * * *